US009877555B1

(12) United States Patent
Tien

(10) Patent No.: US 9,877,555 B1
(45) Date of Patent: Jan. 30, 2018

(54) RAIL MOUNTED BAG

(71) Applicant: Spencer Tien, Irwindale, CA (US)

(72) Inventor: Spencer Tien, Irwindale, CA (US)

( * ) Notice: Subject to any disclaimer, the term of this patent is extended or adjusted under 35 U.S.C. 154(b) by 0 days.

(21) Appl. No.: 15/216,026

(22) Filed: Jul. 21, 2016

Related U.S. Application Data

(63) Continuation-in-part of application No. 29/570,394, filed on Jul. 7, 2016, now Pat. No. Des. 793,720.

(51) Int. Cl.
*A45C 3/00* (2006.01)
*A45C 1/04* (2006.01)
*A45C 13/10* (2006.01)
*A45C 13/30* (2006.01)

(52) U.S. Cl.
CPC ..... *A45C 1/04* (2013.01); *A45C 3/00* (2013.01); *A45C 13/103* (2013.01); *A45C 13/30* (2013.01)

(58) Field of Classification Search
CPC ..... F41C 33/0272; A45C 1/04; A45C 13/30; A45C 3/00; A45C 13/103
USPC ..... 224/195, 196, 197
See application file for complete search history.

(56) References Cited

U.S. PATENT DOCUMENTS 1,648,565 A * 11/1927 Primley ..... A63B 47/00 150/112
4,957,231 A * 9/1990 Kalisher ..... A01K 97/06 224/240
5,151,678 A * 9/1992 Veltri ..... G08B 5/006 340/321
5,397,040 A * 3/1995 Lee ..... A01K 97/06 206/315.11
5,505,354 A * 4/1996 Hutton ..... A01K 97/06 206/315.11
5,584,423 A * 12/1996 Wang ..... A45F 5/021 224/197
5,722,576 A * 3/1998 Rogers ..... A45F 5/02 224/195
5,881,933 A * 3/1999 Rogers ..... A41F 9/02 224/195
6,015,073 A * 1/2000 Wojciak ..... A41F 9/002 2/312
6,098,859 A * 8/2000 Bortner ..... A44B 11/12 224/195
6,152,338 A * 11/2000 Smith ..... A01K 97/10 224/149
6,431,424 B1 * 8/2002 Smith ..... A01K 97/10 224/153
6,457,616 B2 * 10/2002 Gagne ..... A45F 3/16 224/148.4
6,474,523 B2 * 11/2002 Morrison ..... A45F 3/02 224/197

(Continued)

*Primary Examiner* — Brian D Nash
(74) *Attorney, Agent, or Firm* — Clement Cheng

(57) ABSTRACT

A rail mounted bag has a bag. The bag is hollow and configured to store articles. A strap is made of fabric material, flexible and elongated. A rail is mounted on the strap. The rail is mounted to face the bag. A rail carriage is connected to the bag and slidingly connected to the rail. The bag is configured to slide along the rail. The rail is formed of belt rail segments with rail gaps between each of the belt rail segments. The rail is formed as a helix around a helical core. The helical core is an elongated opening parallel to the helix. Each turn of the helix is a rail segment. The bag also optionally includes a rail carriage loop mounted to a bag rear. The rail carriage is mounted to the rail carriage loop.

12 Claims, 8 Drawing Sheets

(56) References Cited

U.S. PATENT DOCUMENTS

| | | | | |
|---|---|---|---|---|
| 6,648,196 | B2 * | 11/2003 | Morrison | A45F 3/02 224/197 |
| 7,175,061 | B2 * | 2/2007 | Dohn | A45F 5/02 224/241 |
| 7,762,440 | B2 * | 7/2010 | Cook | A45F 5/021 2/338 |
| 8,011,545 | B2 * | 9/2011 | Murdoch | A45F 5/02 224/672 |
| 8,225,973 | B1 * | 7/2012 | Bellinson | A45F 3/02 224/257 |
| 8,225,976 | B2 * | 7/2012 | Meunier | A45F 5/02 224/672 |
| 8,510,868 | B2 * | 8/2013 | Mongan | A45F 5/021 2/300 |
| 9,339,102 | B2 * | 5/2016 | Iosilevich | A45F 5/021 |
| 9,392,830 | B2 * | 7/2016 | Simmons, Sr. | A41D 3/00 |
| 2002/0096545 | A1 * | 7/2002 | Chang | A45F 5/02 224/271 |
| 2002/0108980 | A1 * | 8/2002 | Kahn | A45F 5/02 224/268 |
| 2003/0000986 | A1 * | 1/2003 | Smith | A01K 97/10 224/637 |
| 2006/0213944 | A1 * | 9/2006 | Dieter | A45F 3/04 224/648 |
| 2008/0223888 | A1 * | 9/2008 | Meunier | A45F 5/02 224/195 |
| 2009/0039120 | A1 * | 2/2009 | Murdoch | A45C 11/38 224/195 |
| 2012/0111904 | A1 * | 5/2012 | Kim | A45F 3/04 224/158 |
| 2013/0320053 | A1 * | 12/2013 | Kim | A45F 3/02 224/195 |

* cited by examiner

RAIL MOUNTED BAG

This application is a continuation in part and claims priority from U.S. design patent application Ser. No. 29/570,394 entitled Half Zipper Bag filed Jul. 11, 2016 by the same inventor Spencer Tien.

DISCUSSION OF RELATED ART

A variety of different bags can be swiveled such as fanny packs, belt bags and the like. A user typically swivels the belt and back together so that the belt rotates relative to the user as well as the bag. In some circumstances, the belt may have difficulty swiveling relative to the user. Belts can be worn in a variety of orientations such as around the waist, in a sling around the shoulder or otherwise.

SUMMARY OF THE INVENTION

A rail mounted bag system includes has a fabric bag with compartments or pockets. The bag is hollow and configured to store articles that can be closed within such as by zippers. A strap is made of fabric material, flexible and elongated. A rail is mounted on the strap. The rail is mounted to face the bag. A rail carriage is connected to the bag and slidingly connected to the rail. The bag is configured to slide along the rail. The rail is formed of belt rail segments with rail gaps between each of the belt rail segments.

The rail is formed as a helix around a helical core. The helical core is an elongated opening parallel to the helix. Each turn of the helix is a rail segment. The bag also optionally includes a rail carriage loop mounted to a bag rear. The rail carriage is mounted to the rail carriage loop. The rail carriage loop is stitched to the bag. The rail carriage loop can be a fabric loop stitched to the bag. The rail carriage has a rail carriage loop connector formed as an opening. The rail carriage loop passes through the rail carriage loop connector and secures the rail carriage loop connector to the rail carriage loop. The bag further includes a top compartment, a right compartment and a left compartment.

The rail carriage is formed in a clip shaped construction having an upper prong and a lower prong. The upper prong has an upper prong tip, and the lower prong has a lower prong tip. The upper prong tip has an upper prong tip inside surface. The lower prong has a lower prong tip inside surface. The lower prong tip inside surface engages a rail segment lower inside surface. The upper prong tip inside surface engages a rail segment upper inside surface.

Figure 1:
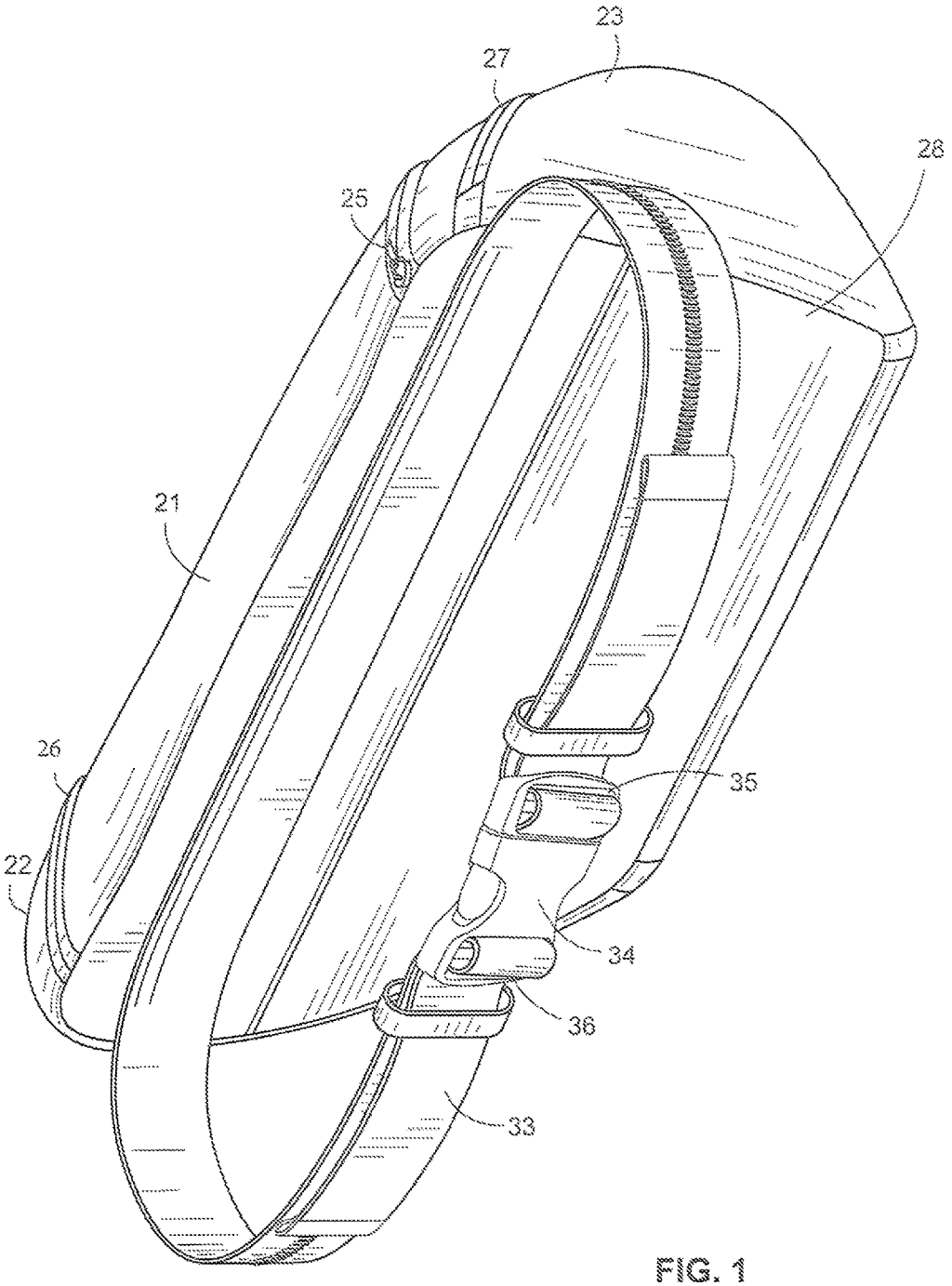
FIG. 1 is a perspective view.
Figure 2:
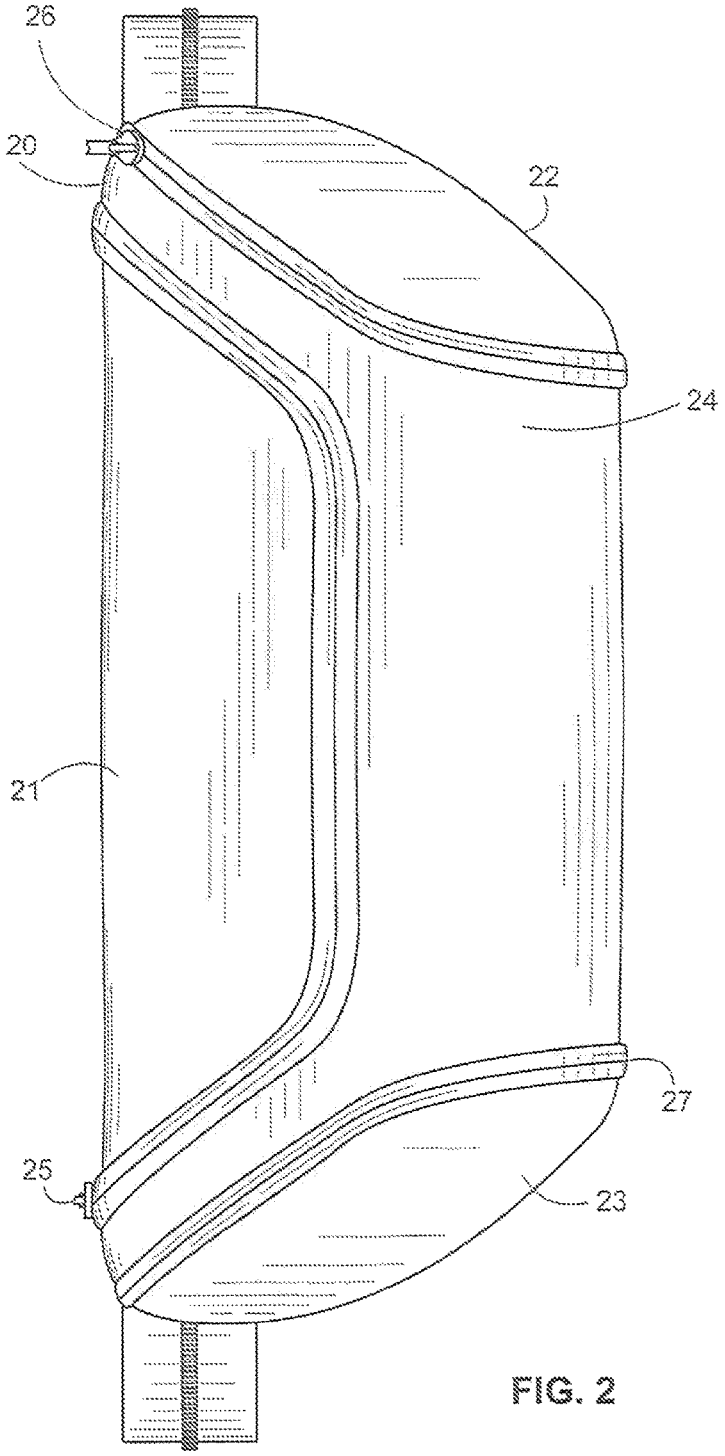
FIG. 2 is a front view.
Figure 3:
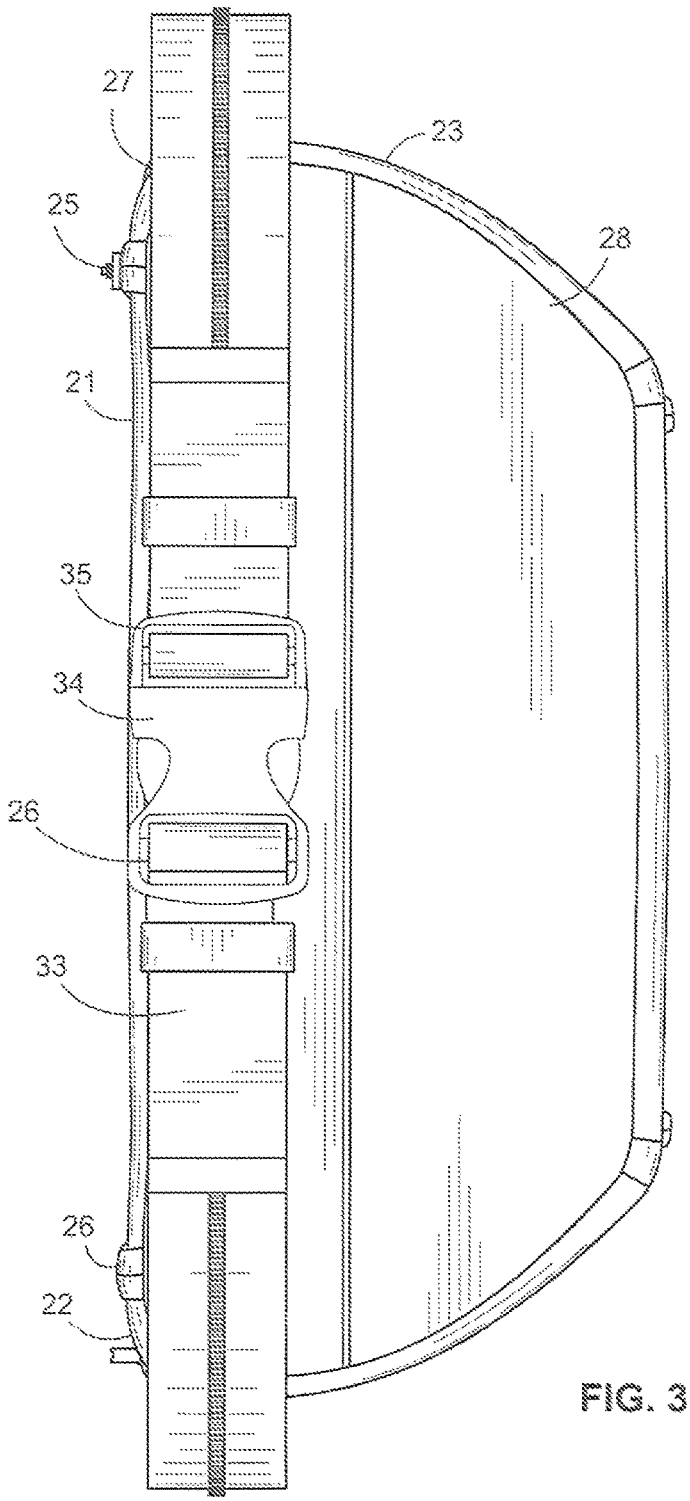
FIG. 3 is a rear view.
Figure 4:
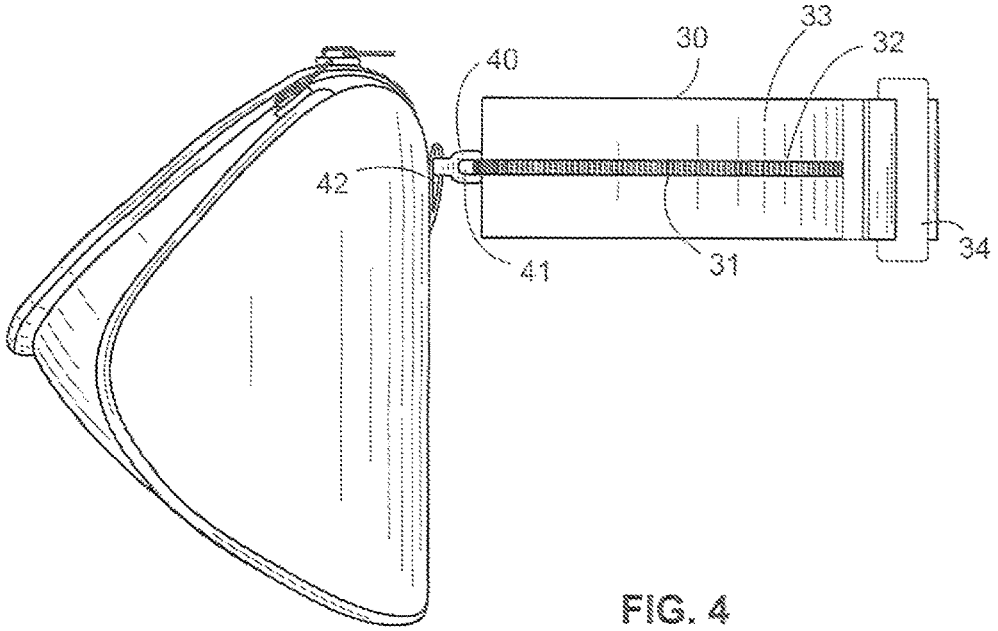
FIG. 4 is a left side view.
Figure 5:
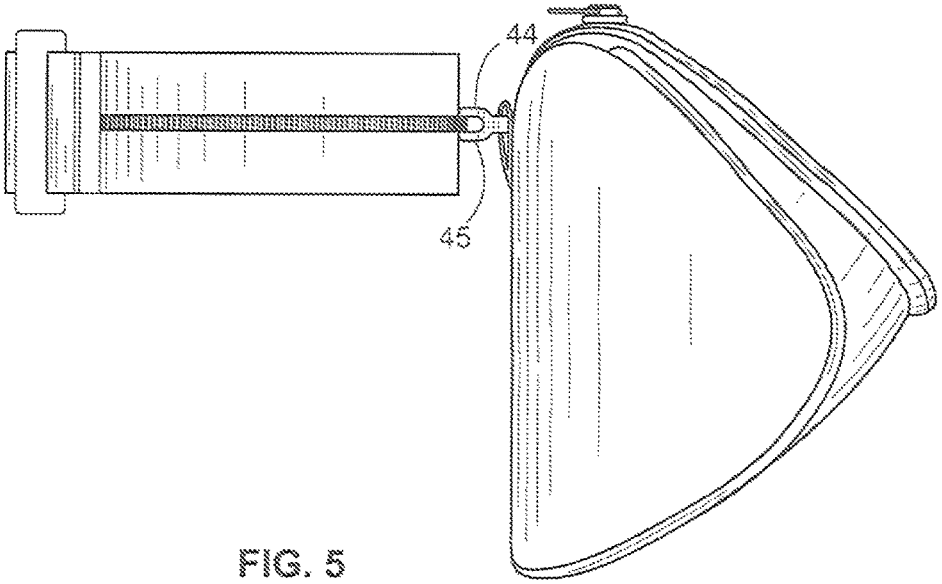
FIG. 5 is a right side view.
Figure 6:
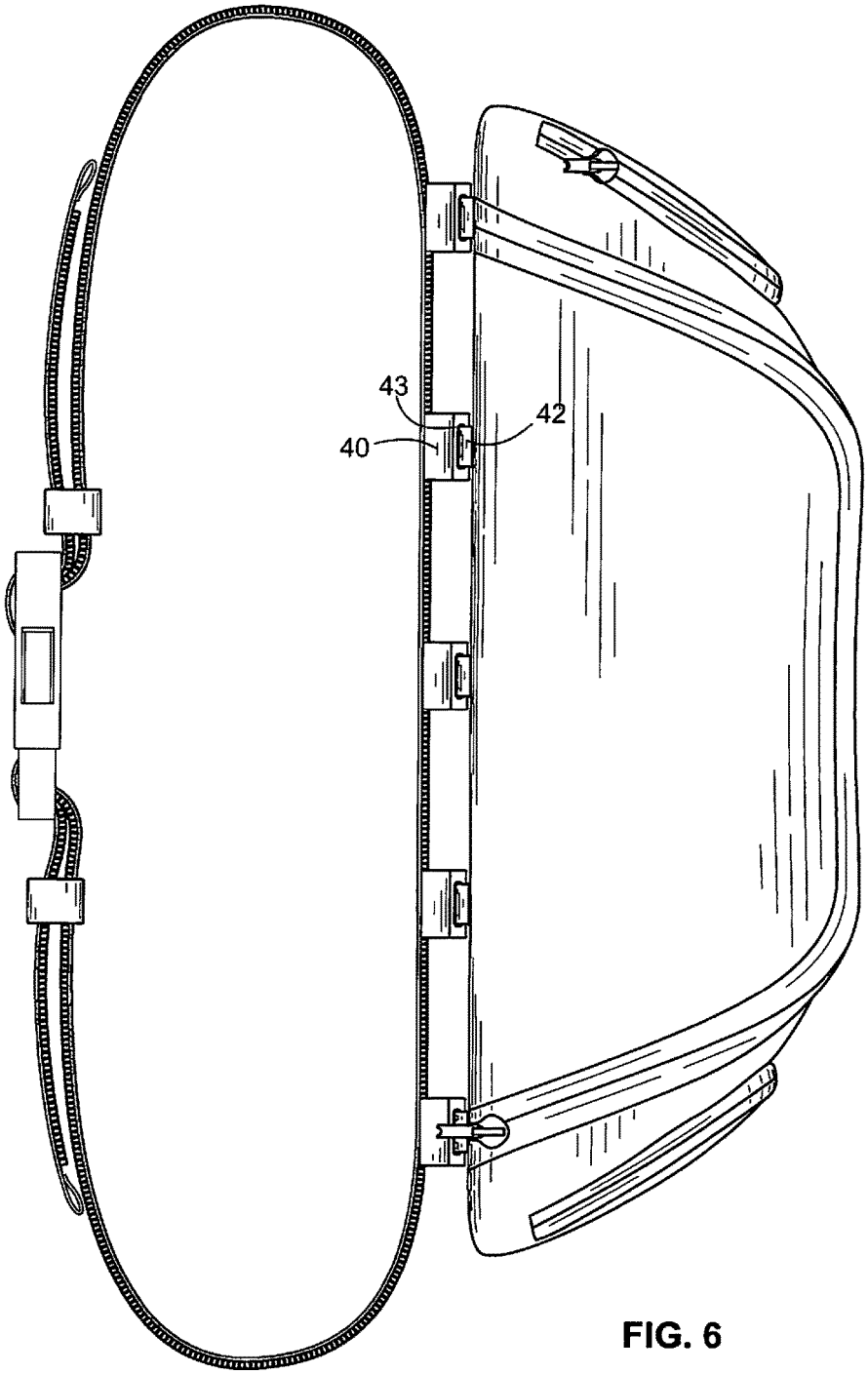
FIG. 6 is a top view.
Figure 7:
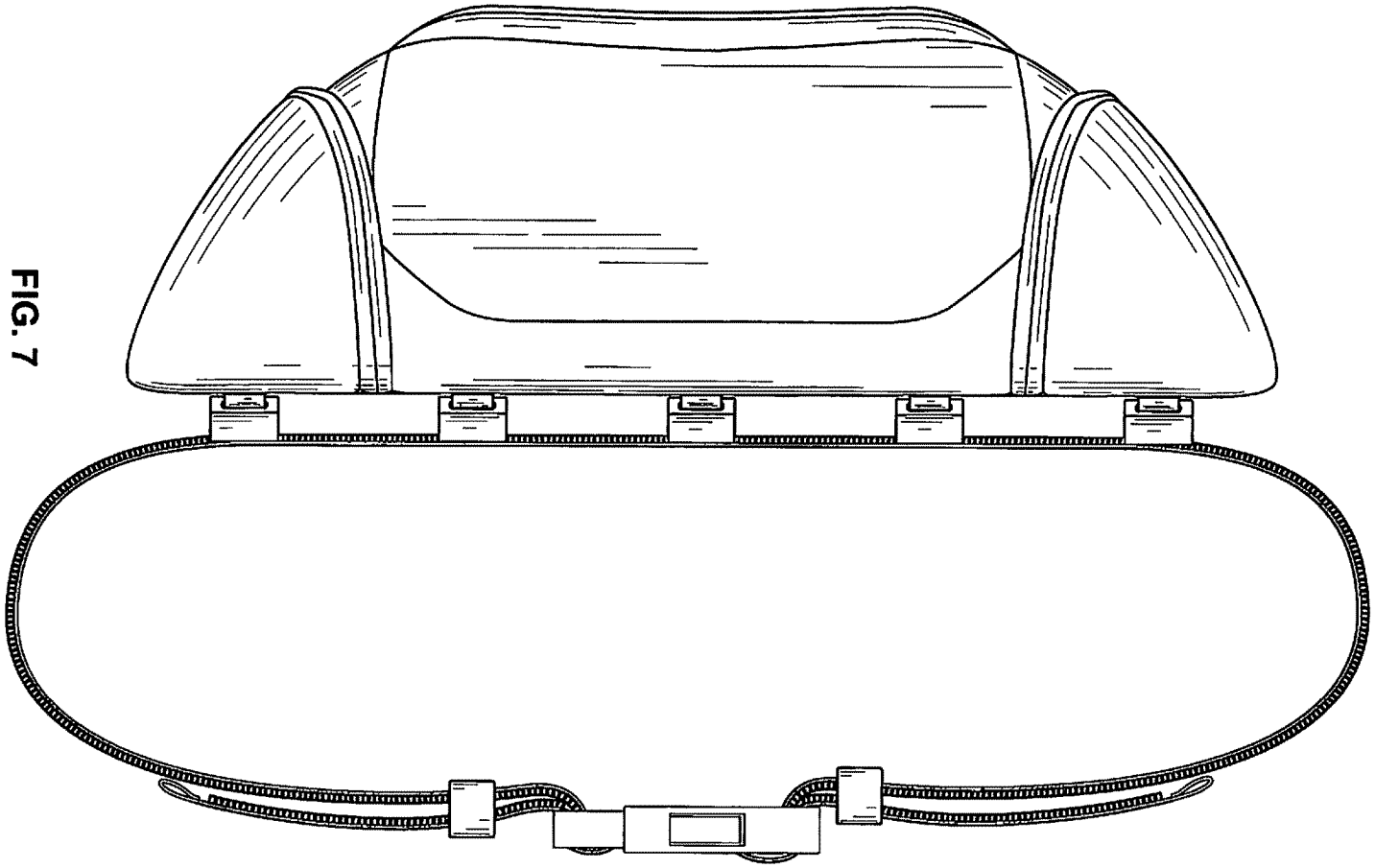
FIG. 7 is a bottom view.
Figure 8:
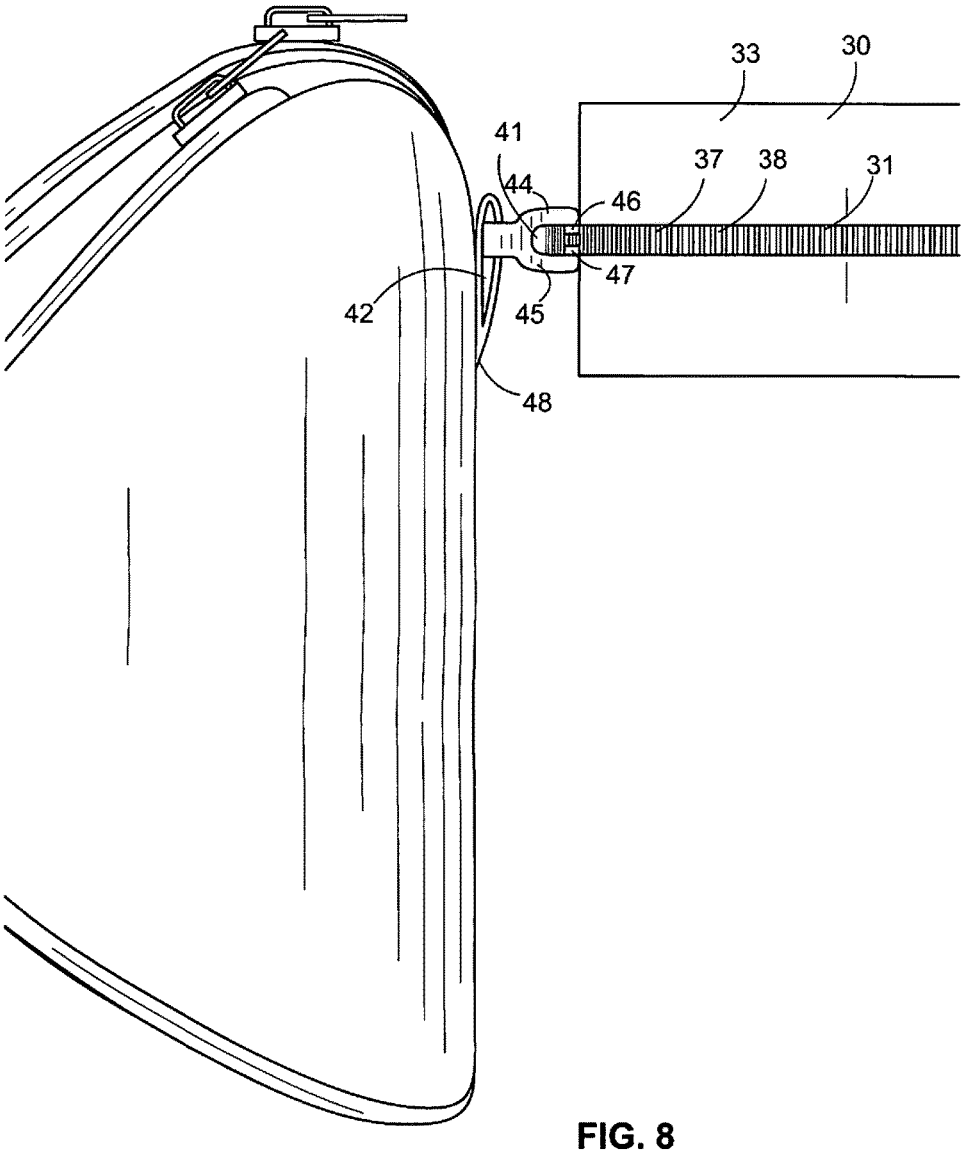
FIG. 8 is a side view of the bag to belt connection.
Figure 9:
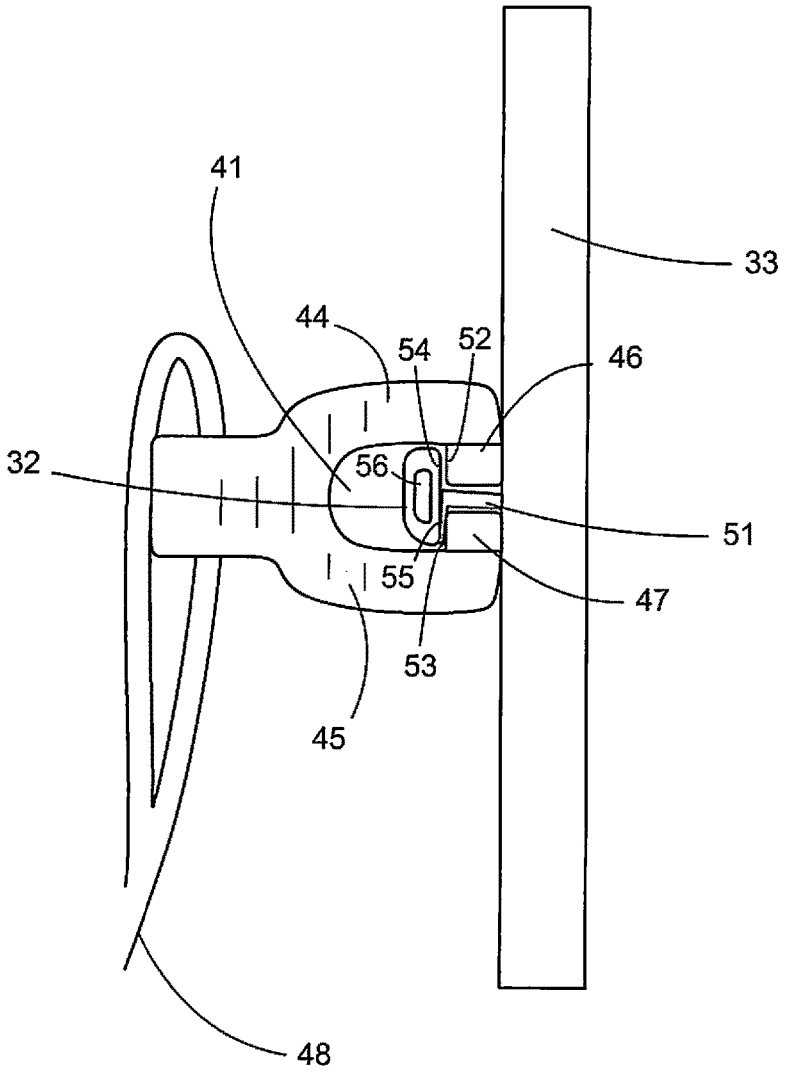
FIG. 9 is a side cross-section view of the carriage rail to rail segment connection.

The following call out list of elements can be a useful guide in referencing the element numbers of the drawings.

20 Bag
21 Top Compartment
22 Right Compartment
23 Left Compartment

24 Bag Front Face
25 Top Compartment Zipper
26 Right Compartment Zipper
27 Left Compartment Zipper
28 Bag Rear
30 Belt
31 Belt Rail
32 Rail Segment
33 Belt Strap
34 Belt Connector
35 Belt Connector First Opening
36 Belt Connector Second Opening
37 Rail Segment Attachment
38 Belt Rail Segment Gap
40 Rail Carriage
41 Rail Carriage Opening
42 Rail Carriage Loop
43 Rail Carriage Loop Connector
44 Upper Prong
45 Lower Prong
46 Upper Prong Tip
47 Lower Prong Tip
48 Rail Carriage Loop Stitching
51 Fabric Extension Strip
52 Upper Prong Tip Inside Surface
53 Lower Prong Tip Inside Surface
54 Rail Segment Upper Inside Surface
55 Rail Segment Lower Inside Surface
56 Helical Core

DETAILED DESCRIPTION OF THE PREFERRED EMBODIMENT

A bag 20 has a top compartment 21, a right compartment 22 and a left compartment 23. The top compartment 21 is sealed by a top compartment zipper 25. The right compartment 22 is sealed by a right compartment zipper 26. The left compartment 23 is sealed by a left compartment zipper 27. The bag has a front side and a bag rear 28. The bag can be made of fabric material such as polyester or cotton. The adjacent compartments of the bag can be separated by mesh material. The bag is preferably a soft shell for being worn by a user that can carry articles such as cell phones, batteries, cameras, firearms and portable radios.

The bag can be secured to a strap such as a belt 30 that is made of a belt strap having a belt rail mounted on the belt strap. The belt has a belt rail 31 which is preferably a half zipper. Typically, zippers are used in pairs with a left zipper side connecting to a right zipper side so that the zipper pairs can be visit together. However, in this case, the belt rail can be made of half of a zipper, which uses the zipper in a different manner than originally intended. The half zipper does not necessarily zip to another member. The belt rail 31 is comprised of multiple belt rail segments 32 that are stitched to a belt strap 33. Stitch loops secure the belt rail segments 32 to the belt strap 33. The belt 30 does not need to move relative to the user's body when the bag is swiveled from a student position behind the user to a ready position in front of the user, or to the side of the user.

Preferably, the number of belt rail segments 32 are between three and ten per centimeter. Each of the belt rail segments 32 are slick plastic members such that they allow the rail carriage 40 to slide along the belt rail segments 32. The rail carriage 40 is formed in a clip shape. The slippery and slick construction of the belt rail segments 32 allows the bag to slide along the belt which allows rotation around the user. The entire bag slides together including the top compartment 21, the right compartment 22, and the left compartment 23. Preferably, the right compartment 22 and the left compartment 23 are rounded so that they do not catch on user clothing. The belt rail including the belt rail segments allow a user to rotate the bag quickly from a rear carrying mode to a front carrying mode. When the bag is in the rear carrying mode, the back of the bag also called the bag rear 28 can be facing the user's back, and when the bag is in the front carrying mode, the bag rear 28 can be facing the user's abdomen.

The rail carriage 40 includes a rail carriage opening 41. The rail carriage opening 41 is a slot that receives the belt rail 31. The belt rail 31 has multiple belt rail segments 32 in a linearly oriented configuration. Therefore, the rail carriage opening 41 allows the rail carriage to attach to the belt rail 31. The belt rail 31 is stitched to the belt strap 33 at the stitch loops. The belt rail segments 32 include individual rail segment attachments 37. Belt rail segment gaps 38 are formed between the belt rail segments 32 when the stitch loops are spaced apart from each other so that the belt rail segments 32 and the belt rail segment attachments 37 are spaced apart at regular intervals.

The rail carriage 40 has an upper prong 44 above the rail carriage opening 41 and a rail carriage lower prong 45 below the rail carriage opening 41. The upper prong 44 has an upper prong tip 46 and the lower prong 45 has a lower prong tip 47. The upper prong tip 46 secures to the belt rail segments and the lower prong tip 47 also secures to the belt rail segments. The belt rail segments are held in the rail carriage opening 41 by the upper prong tip 46 and the lower prong tip 47. The upper prong 44 and the lower prong 45 can be made as separate pieces of plastic from the rail carriage 40, but preferably the upper and lower prong are integrally formed rather than separately formed.

Preferably, five rail carriages 40 connect the belt rail 31 to the bag 20. The rail carriages 40 connect to the bag 20 at rail carriage loops 42. The rail carriage loops 42 are preferably stitched to the bag 20. The rail carriages 40 have a rail carriage loop connector 43. The rail carriage loop connector can be formed as a rectangular opening that receives the rail carriage loop 42 that it is assigned to. Therefore, preferably five rail carriage loops 42 are attached to the bag rear 28 of the bag 20 and the five rail carriage loops 42 connect the belt rail 31 to the bag rear 28 of the bag 20. The rail carriages 40 can be made of slick plastic such as high density polyethylene or high density polypropylene, or PVC. The rail carriage loops 42 are preferably made of fabric strips stitched to a bag rear 28. The bag rear 28 can have a backing strip that overlies the rail carriage loops 42 such that the backing strip is stitched to the rail carriage loops 42 so as to connect the backing strip to the bag rear 28 and provide a secure connection to the bag 20. The backing strip is stitched into the rail carriage loop 42 at the carriage rail loop stitching 48. The carriage rail loop stitching is preferably elongated, linear and generally parallel to the belt rail 31.

The belt 30 can have a pair of ends that connect together releasably at a belt connector 34. The belt connector 34 can be a buckle, or a clasp commonly used for connecting fabric belts. The belt connector 34 has a belt connector first opening 35 and a belt connector second opening 36. The belt connector first opening 35 connects to the first end of the belt and the belt connector second opening 36 connects to the second end of the belt. The belt connector second opening 36 receives the second end of the belt and the belt connector first opening 35 receives the first end of the belt. The belt can be looped through the connector and then the remaining free slack portion of the belt can pass through a belt retaining member.

The belt rail 31 includes rail segments 32 mounted on a fabric extension strip 51. The fabric extension strip 51 is part of the belt rail 31 and is stitched to the belt strap 33 of the belt 30. Preferably, the fabric extension strip 51 has a thickness that is less than the thickness of the belt strap 33 of the belt 30.

The fabric extension strip 51 is stitched to each individual rail segment 32 with thread. Each individual rail segment can have indentations for openings that receive a path of thread to retain the alignment and orientation of the rail segment 32 to the fabric extension strip 51. The parts of the rail segment 32 also remain in proper alignment. The upper prong tip has an upper prong tip inside surface 52. The lower prong tip has a lower prong tip inside surface 53. The rail segment has a rail segment upper inside surface 54 and a rail segment lower inside surface 55. The rail segment upper inside surface 54 rides along the upper prong tip inside surface 52 in a low friction sliding relationship. Similarly the rail segment lower inside surface 55 rides along the lower prong tip inside surface 53.

The fabric extension strip 51 passes between the upper prong tip inside surface 52 and the lower prong tip inside surface 53. The rail segment upper inside surface 54 is above the fabric extension strip 51. The rail segment lower inside surface 55 is below the fabric extension strip 51. The fabric extension strip 51 is connected to the rail segment 32 between the rail segment lower inside surface 55 and the rail segment upper inside surface 54. Preferably, the fabric extension strip 51 bisects the rail segment lower inside surface 55 and the rail segment upper inside surface 54 so that the surface area of the rail segment lower inside surface 55 is roughly equivalent to the rail segment upper inside surface 54.

The fabric extension strip 51 can be connected to the rail segment 32 on a side of the fabric extension strip 51. The fabric extension strip 51 can be bent downward or upward. The fabric extension strip 51 if bent downward can pass between the rail segment lower inside surface 55 and the lower prong tip inside surface 53. Thus, when the rail segment lower inside surface 55 rides on the lower prong tip inside surface 53, the rail segment lower inside surface 55 is formed on a side of the bent fabric extension strip 51 rather than on a surface of the non-fabric plastic rail segment 32. The bent fabric extension strip 51 defining the rail segment lower inside surface 55 can be contacting and sliding against the lower prong tip inside surface 53. Similarly, the bent fabric extension strip 51 can be bent upward and then be sliding against the upper prong tip inside surface 52.

When spaced apart from each other, the rail segments 32 can have belt rail segment gaps 38 that are angled rather than straight. The angled belt rail segment gaps 38 can be formed between angled rail segments 32. The rail segments 32 are preferably not orthogonal to the fabric extension strip 51, although they could be made orthogonal. The rail segments 32 are preferably lightweight and formed of a single type of material in an elongated structure. The rail segments preferably have a high that is greater than a width of the rail segment. The rail segments can be formed in a spiral shaped helix such that the rail segment material is continuous but still with angled belt rail segment gaps 38. When formed as a helix, or a double helix, the rail segments have angled belt rail segment gaps 38 that are angled at a pitch of the spiral. Thus, the rail segments can be integrally formed rather than separately formed. The rail segments can be made as a single piece as well as made as separate pieces.

A rail segment helical core 56 is parallel to the fabric extension strip. The rail segment helical core 56 is an elongated opening that defines the middle of the rail segment 32. Each rail segment 32 is a turn of the helix around the helical core when the rail segments 32 are made in a helix rather than in separate segments. The shape of the helical core 56 can be defined during manufacturing in a continuous process so that the helical core 56 is uniform along the length of the belt rail 31. An extending die in the shape of a protruding rod or hook can define a constant shape of a helical core 56 as a plastic line is rotated about the extending die so as to generate the rail segments in rapid succession. The belt rail 31 when made as a helix, can have a coil spring flexibility to provide a resilient rail for receiving the carriage.

A variety of obvious modifications to the present invention can be made without departing from the spirit of the invention. The following claims define the scope of the invention.

The invention claimed is:

1. A rail mounted bag system comprising:

a. a bag wherein the bag is hollow and configured to store articles;

b. a strap, wherein the strap is made of fabric material, flexible and elongated;

c. a rail mounted on the strap, wherein the rail is mounted to face the bag, d. a rail carriage connected to the bag and slidingly connected to the rail, wherein the bag is configured to slide along the rail, wherein the rail is formed of belt rail segments with rail gaps between each of the belt rail segments.

2. The rail mounted bag system of claim 1, wherein the bag further includes a rail carriage loop mounted to a bag rear, wherein the rail carriage is mounted to the rail carriage loop, wherein the rail carriage loop is stitched to the bag.

3. The rail mounted bag system of claim 2, wherein the rail carriage loop is a fabric loop stitched to the bag, wherein the rail carriage has a rail carriage loop connector formed as an opening, wherein the rail carriage loop passes through the rail carriage loop connector and secures the rail carriage loop connector to the rail carriage loop.

4. The rail mounted bag system of claim 1, wherein the bag further includes a top compartment, a right compartment and a left compartment.

5. The rail mounted bag system of claim 1, wherein the rail carriage is formed in a clip shaped construction having an upper prong and a lower prong, wherein the upper prong has an upper prong tip, and wherein the lower prong has a lower prong tip.

6. The rail mounted bag system of claim 5, wherein the upper prong tip has an upper prong tip inside surface, wherein the lower prong has a lower prong tip inside surface, wherein the lower prong tip inside surface engages a rail segment lower inside surface, wherein the upper prong tip inside surface engages a rail segment upper inside surface.

7. The rail mounted bag system of claim 1, wherein the rail is formed as a helix around a helical core, wherein the helical core is an elongated opening parallel to the helix, wherein each turn of the helix is a rail segment.

8. The rail mounted bag system of claim 7, wherein the bag further includes a rail carriage loop mounted to a bag rear, wherein the rail carriage is mounted to the rail carriage loop, wherein the rail carriage loop is stitched to the bag.

9. The rail mounted bag system of claim 8, wherein the rail carriage loop is a fabric loop stitched to the bag, wherein the rail carriage has a rail carriage loop connector formed as an opening, wherein the rail carriage loop passes through the rail carriage loop connector and secures the rail carriage loop connector to the rail carriage loop.

10. The rail mounted bag system of claim 7, wherein the bag further includes a top compartment, a right compartment and a left compartment.

11. The rail mounted bag system of claim 7, wherein the rail carriage is formed in a clip shaped construction having an upper prong and a lower prong, wherein the upper prong has an upper prong tip, and wherein the lower prong has a lower prong tip.

12. The rail mounted bag system of claim 11, wherein the upper prong tip has an upper prong tip inside surface, wherein the lower prong has a lower prong tip inside surface, wherein the lower prong tip inside surface engages a rail segment lower inside surface, wherein the upper prong tip inside surface engages a rail segment upper inside surface.

* * * * *